US005894005A

United States Patent [19]

Steel et al.

[11] Patent Number: 5,894,005

[45] Date of Patent: Apr. 13, 1999

[54] SYSTEM FOR IDENTIFYING CASTINGS AND FOR TRACKING CASTING PROCESS PARAMETERS

[75] Inventors: Geoffrey R. Steel, Windsor, Canada; John D. Bogatay, Grosse Ile, Mich.; Bernard J. Brosnan, Dearborn Heights, Mich.; Philip A. Coffey, Farmington Hills, Mich.

[73] Assignee: Ford Global Technologies, Inc., Dearborn, Mich.

[21] Appl. No.: 08/959,951

[22] Filed: Oct. 24, 1997

Related U.S. Application Data

[63] Continuation of application No. 08/628,067, Apr. 8, 1996, abandoned.

[51] Int. Cl.[6] ..... B29C 45/76

[52] U.S. Cl. ..... 264/40.1; 249/103; 425/135

[58] Field of Search ..... 249/103; 425/135; 264/40.1

[56] References Cited

U.S. PATENT DOCUMENTS

| | | | |
|---|---|---|---|
| 4,137,962 | 2/1979 | Pol . | |
| 4,175,236 | 11/1979 | Juvinall | 250/223 B |
| 4,230,266 | 10/1980 | Juvinall | 250/223 B |
| 4,342,549 | 8/1982 | Lemelson . | |
| 4,384,702 | 5/1983 | Boskovic | 249/103 |
| 4,518,338 | 5/1985 | Hehl . | |
| 4,619,306 | 10/1986 | Gruner et al. . | |
| 4,620,353 | 11/1986 | Pryor . | |
| 4,644,151 | 2/1987 | Juvinall | 250/223 B |
| 4,708,314 | 11/1987 | Kuhling . | |
| 5,057,000 | 10/1991 | Mangone, Jr. . | |
| 5,125,448 | 6/1992 | Jensen | 164/155 |
| 5,235,853 | 8/1993 | Froes . | |
| 5,318,418 | 6/1994 | Netto . | |
| 5,329,985 | 7/1994 | Weimann . | |
| 5,329,989 | 7/1994 | Wilson . | |
| 5,571,539 | 11/1996 | Starkey | 425/135 |

FOREIGN PATENT DOCUMENTS

| | | |
|---|---|---|
| 0 027 237 | 4/1981 | European Pat. Off. . |
| 0 363 791 | 4/1990 | European Pat. Off. . |
| 2124967A | 2/1984 | United Kingdom . |
| 92/11102 | 7/1992 | WIPO . |

*Primary Examiner*—Tim Heitbrink
*Attorney, Agent, or Firm*—Jerome R. Drouillard

[57] ABSTRACT

A method and system for identifying casting includes writers for applying unique identification indicia to the inside and outside of a molding core package. The identification indicia and at least one operating parameter associated with the molding process, such as day, time, melt temperature, melt composition, or other operating variables are tracked and recorded by a molding controller such that castings having a particular characteristic may be identified after the molding process has been completed.

16 Claims, 2 Drawing Sheets

SYSTEM FOR IDENTIFYING CASTINGS AND FOR TRACKING CASTING PROCESS PARAMETERS

This application is a continuation of application Ser. No. 08/628,067, filed Apr. 8, 1996, now abandoned.

BACKGROUND OF THE INVENTION

1. Field of the Invention

The present invention relates to a system for uniquely identifying castings in serial production, for tracking operating parameters associated with a molding process, and for recording sensed values of such parameters for each individual casting produced by a casting process.

2. Background Information

High volume production of castings used, for example, in automotive engines, typically involves molding by means of sand core packages. According to common practice, each sand core package is assembled from pre-made cores which are filled with melt, cooled, and further processed. Additional processing may include, for example, thermal reclamation of the core sand. Although it is desirable to uniquely identify castings for quality control and other reasons, efforts to provide such identification have generally not been successful in the context of high volume casting operations. One common practice has been to apply a tag or date code to molds, such that the date and a particular work shift are provided in raised relief in the finished product. Unfortunately, in high-volume production, thousands of parts may be made in a single shift, and problems associated with the casting process could necessitate scrapage and/or recall of all the parts produced in a given shift, for that matter, a plurality of shifts. It is desirable, therefore, to have the capability of associating or recording data pertaining to a casting process with each particular cast workpiece. In this manner, if it is determined subsequently that one or more cast workpieces were molded at a time when process parameters were out of specification, the affected castings may be identified with specificity.

The inventors of the present invention have fortuitously devised a system and method for providing unique identification of each casting produced in a foundry, while at the same time providing a system and method for tying each casting to and recording with the casting a plurality of operating parameters associated with the casting process. Thus, as noted above, if imperfect parts or workpieces are produced by the casting process because one or more of the operating parameters drifts out of acceptable limits, the affected parts may be readily identified by doing a search of a memory storage device situated within a molding controller, which will have data sets corresponding to the unique identification for each particular casting, coupled with recorded values for various parameters associated with the molding process.

It is an advantage of the present invention that a system according to this invention may be used to control casting inventories and to provide field service for castings, because each casting will be uniquely identified and the characteristics of the casting process pertaining to each particular casting will be readily ascertainable.

Other advantages of the present invention will become apparent to the reader of this specification.

SUMMARY OF THE INVENTION

A system for identifying castings includes a writer for forming moldable identification indicia in a workpiece shaping surface of mold, and a data logger for recording a data set for each casting with the data set including both the moldable identification indicia and a value for at least one parameter associated with the molding process. A writer used in a system according to the present invention may comprise either a machine-driven scriber for engraving identification indicia in a mold such that the identification indicia appear in raised relief in a workpiece shaped by the mold. Alternatively, the writer may comprise a computer controlled surface working tool for forming identification indicia in relief in a mold. Thus, the letters, numbers, alphanumeric code, or other type of identification indicia could be formed in either raised or lowered relief in a finished workpiece.

According to yet another aspect of the present invention, a casting identification system comprises an external identification writer for applying outer surface identification indicia to an outer surface of a mold such that the previously described moldable identification indicia and the outer surface identification indicia are in correspondence. If desired, both sets of indicia may be identical. A point here is that the moldable identification indicia are generally not readable after the core package has been assembled, it being understood that the moldable identification indicia are necessarily inscribed in an inner surface of the core package which will be exposed to melt during the pouring of melt into the core package.

According to yet another aspect of the present invention, at the approximate time the mold is filled with melt, a data logger receives a signal transmitted from a camera trained upon the outer surface identification indicia located on an outer surface of the mold. In this manner, a molding controller which controls the filling of the mold will be able to enter into a memory storage device a unique set of identification indicia for each particular part produced by the molding process, and the unique identification indicia will be part of the data set for each individual casting. Each data set will include a signal derived from the outer surface identification indicia and a value of a least one parameter associated with the molding process.

Finally, according to another aspect of the present invention, a method for operating a molding system so as to uniquely identify each one of a plurality of castings and to record values of process parameters associated with each individual casting, comprises the steps of: (1) using a first controller to control a surface working tool so as to form moldable identification indicia in a workpiece shaping surface of a mold, with such first controller also controlling an external identification writer so as to apply outer surface identification indicia to an outer surface of the mold, with the moldable identification indicia and the outer surface identification indicia being in correspondence.

The present method further includes using a second controller to control the filling of the mold and for recording a data set for each individual casting, with each data set including a signal derived from the outer surface identification indicia and at least one parameter associated with the molding process, such that the recorded outer surface identification indicia and the recorded value of at least one parameter will be maintained within a memory storage device housed within the second controller.

DETAILED DESCRIPTION OF PREFERRED EMBODIMENTS

Figure 1:
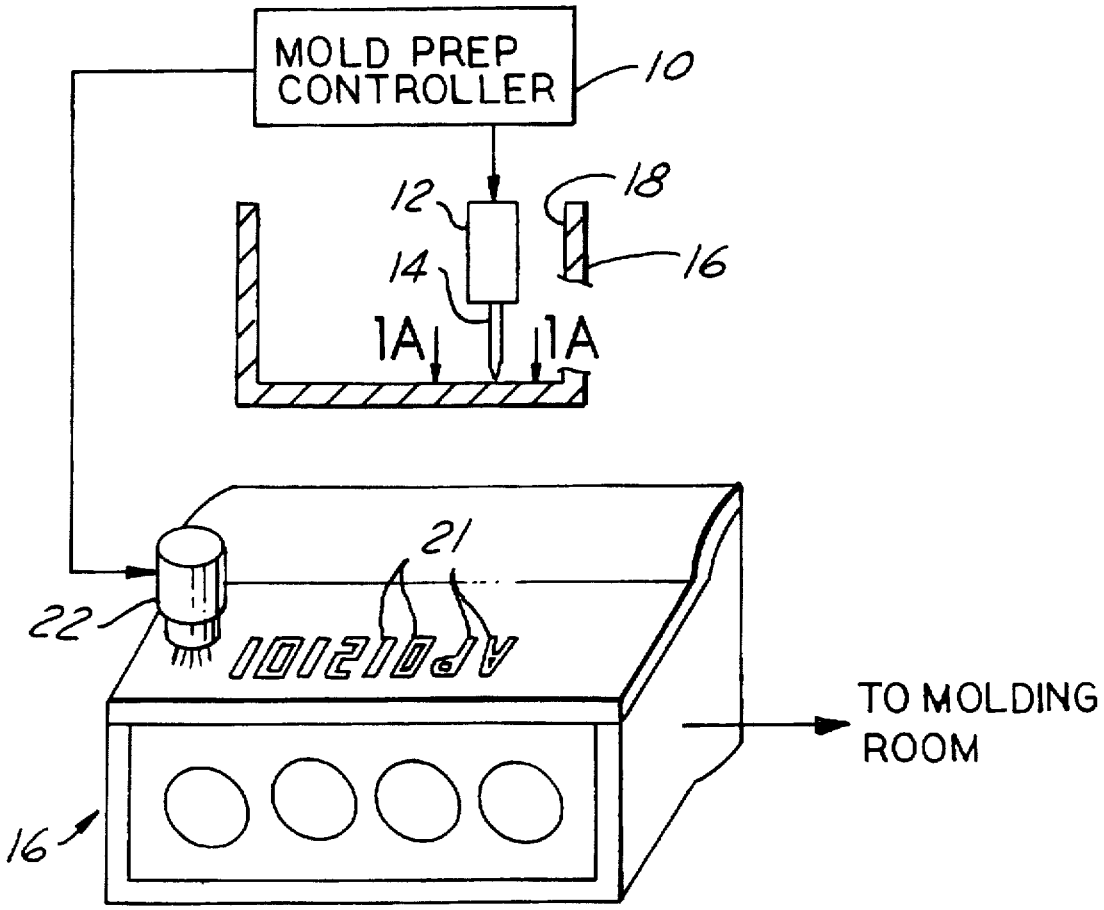
FIG. 1, is schematic representation of a mold preparation system according to the present invention.

As shown in FIG. 1, a system for identifying castings and for recording process parameters begins in the core room of a foundry, where mold prep controller 10 operates a surface working tool, in this case scriber head 12 having a scriber stylus 14 attached thereto, to engrave identification indicia in workpiece shaping surface 18 which is on the inside of mold package 16.

Figure 1A:
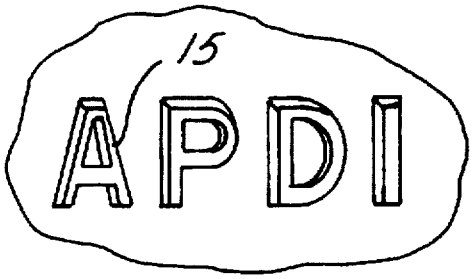
FIG. 1A is a surface segment of a workpiece shaping surface of a mold containing indicia engraved in a mold.

The results of the scribing process are shown in FIG. 1A. Note that the alphanumeric code 15 is engraved into workpiece forming surface 18 of mold 16. Those skilled in the art will appreciate, in view of this disclosure, that the type of scriber head 12 and engraving point 14 used in a system according to the present invention may comprise any one of a variety of such scriber heads and styli. Moreover, the particular program used to operate the scriber and stylist could be drawn from a veritable plethora of such programs used in the machine tool industry and elsewhere for the purpose of providing three-dimensional engraving upon a surface. The precise aspects of such a program are known to those skilled in the arts to which this disclosure pertains and are beyond the scope of the present invention.

Figure 2:
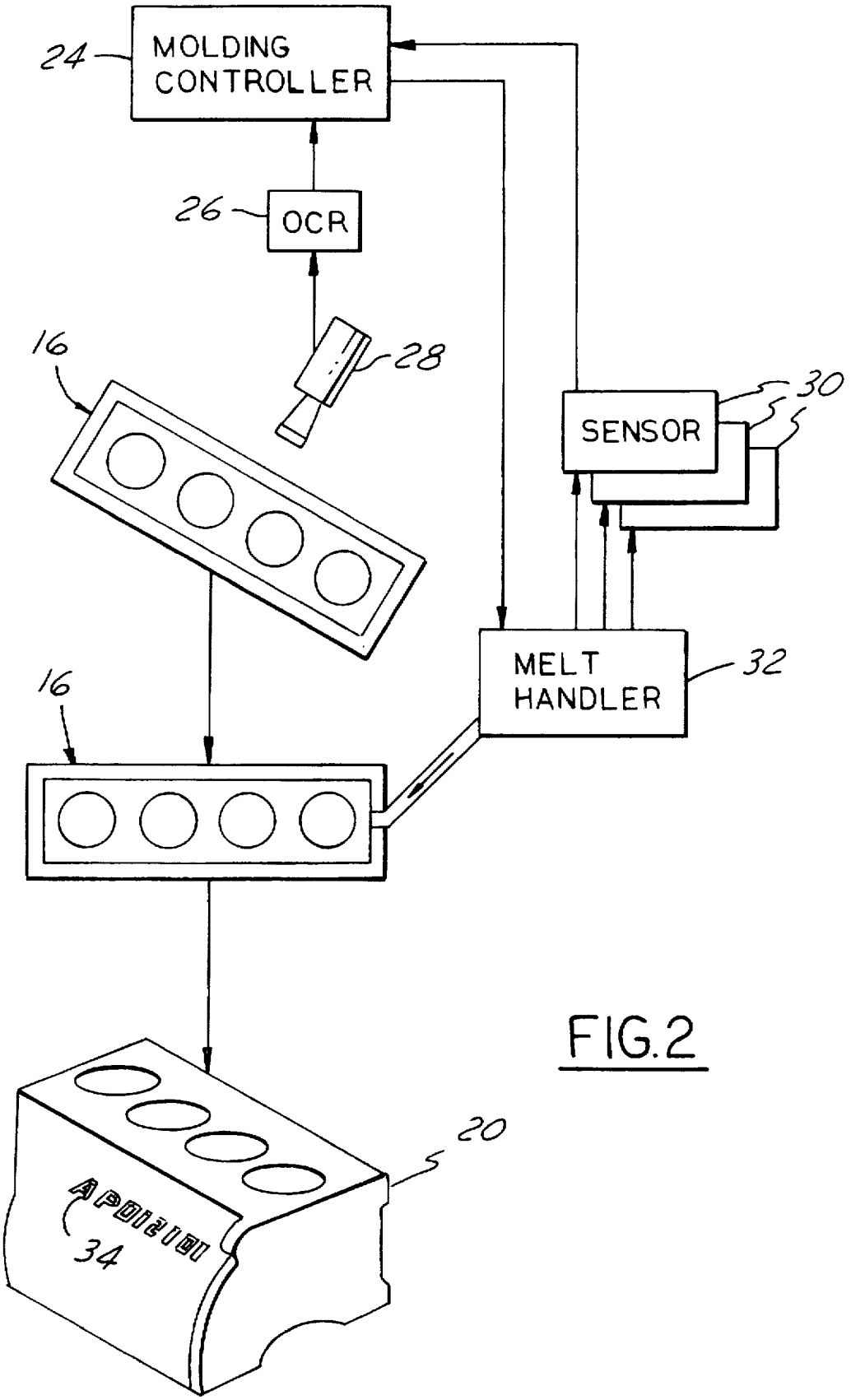
FIG. 2, is schematic representation of a molding process according to the present invention.

The work of mold prep controller 10, scriber head 12, and stylus 14 produces a series of moldable identification indicia in surface 18 of mold 16. The first set of identification indicia are said to be moldable because metal or other melt, upon entering the mold, will flow into the engraved areas, so as to produce raised relief indicia in a desired manner. These raised relief indicia, 34, are shown in FIG. 2, as being applied to the side of a workpiece, which in this case is engine block 20, which has been released from mold 16.

After mold prep controller 10 and scriber head 12 engrave identification indicia on surface 18, mold 16 passes to another station wherein an external identification writer, in this case inkjet printer 22, sprays a set of outer surface identification indicia 21 on the outside of core package 16, in a location such that the sprayed outer surface indicia may be read optically at a later time during the molding process.

The inventors of the present invention have applied the inventive method and system to serial production of high volume aluminum castings using a reclaimable sand core process. The present system has been successfully employed with engine castings such as cylinder blocks and cylinder heads. Those skilled in the art will appreciate in view of this disclosure, however, that the present method and system could be employed with other moldable materials, such as ferrous and nonferrous metals and nonmetallic compounds cast with sand molds and, for that matter, any other type of mold in which at least a portion of the mold is replaceable after each molding operation. For example, if used with a plastic molding process, the mold could be provided with a replaceable interior panel suitable for engraving by the present system; a replaceable or cleanable exterior panel suitable for marking with inkjet printer 22 according to the present invention could also be employed.

Following preparation of mold 16 according to the present invention, the finished core package 16 moves to a mold room, wherein molding controller 24 not only controls the filling of mold 16 with melt from melt handler 32, but also records a data set. A plurality of sensors 30 tracks such operating parameters associated with the casting process, and specifically with melt handler 32, such as the time required to fill the mold or core package with melts and other parameters such as the chemical composition of the melt, the level of molten metal or other type of melt in the feed furnace, the temperature of the melt, and other parameters known to those skilled in the casting art and suggested by this disclosure. The outputs of the various sensors 30 are recorded by a memory storage device within molding controller 24. For this purpose, molding controller 24 could comprise either a simple data logger or personal computer or another type of process computer known to those skilled in the art and suggested by this disclosure. In any event, the data set, including the output of sensors 30 and, if desired, the time and date that the melt is introduced by melt handler 32 into mold 16, comprises part of the data set, with a complete data set including a signal derived from outer surface identification indicia 21 by camera 28, which is trained upon indicia 21 and which feeds its output to optical character reader 26. For the purposes of this disclosure, the set of parameters associated with the molding process may include date and time of day data, and sensors 30 may include a clock time sensor.

Once the outputs of sensors 30 and indicia 21 are recorded by molding controller 24, the operators of a system according to the present invention will be able to search the resulting file to find the identification indicia of castings which have any particular casting variable which might, for example, cause undesirable characteristics such as excessive porosity, structural weakness, or other defects.

While the invention has been shown and described in its preferred embodiments, it will be clear to those skilled in the arts to which it pertains that many changes and modifications may be made thereto without departing from the scope of the invention. For example, melt handler 32 may comprise either a simple ladle pouring system, or a more sophisticated mold filling system such as those currently employed for aluminum casting and having electromagnetically driven molten metal pumps. Yet other changes may occur to those skilled in the art in view of this disclosure. For example, inkjet printer 22 may be replaced by a read-write memory chip, or by a magnetic or visual bar code device or other type of device suggested by this disclosure.

What is claimed:

1. A method for operating a molding system so as to uniquely identify each one of a plurality of castings and to record values of process parameters associated with each individual casting, comprising the steps of:

using a first controller to control a surface working tool so as to form unique, moldable identification indicia in a replaceable shaping surface of a mold such that a workpiece from the mold is uniquely identifiable, with said first controller also controlling an external identification writer so as to apply unique outer surface identification indicia to an outer surface of the mold, with the moldable identification indicia and the outer surface identification indicia being in correspondence; and using a second controller to control the filling of the mold and for recording a data set for each individual casting, with said data set including a signal derived from the unique outer surface identification indicia and at least one parameter associated with the molding process, such that the unique recorded outer surface identification indicia and the recorded value of said at least one parameter will be maintained within a memory storage device within said second controller.

2. A method according to claim 1, wherein said external identification writer comprises an inkjet printer, with said second controller receiving a digital signal from an optical character reader coupled to a camera trained upon the outer surface identification indicia at approximately the time the mold is filled.

3. A method according to claim 1, wherein said data set comprises, for each casting:

a unique casting number;

the time of day at which the mold is filled; and the date on which the mold is filled.

4. A method according to claim 3, wherein said data set further comprises a value corresponding to the amount of time required to fill the mold.

5. A method according to claim 3, wherein said data set further comprises at least one value corresponding to the chemical composition of the melt.

6. A system for identifying serially produced castings and for tracking process parameters during a molding process, comprising:

a writer for forming moldable, unique identification indicia in a workpiece shaping, replaceable surface of a mold such that each workpiece has molded identification indicia which are different from the indicia on every other workpiece; and a data logger for recording a unique data set for each casting, with said data set including both said unique identification indicia and a value of at least one parameter associated with the molding process.

7. A system according to claim 6, wherein said writer comprises a machine-driven scriber for engraving said identification indicia in a mold such that the identification indicia appear in raised relief in a workpiece shaped by the mold.

8. A system according to claim 6, wherein said writer comprises a computer controlled surface working tool for forming said identification indicia in relief in a mold.

9. A system according to claim 6, further comprising an external identification writer for applying outer surface identification indicia to an outer surface of a mold such that the moldable identification indicia and the outer surface identification indicia are in correspondence.

10. A system according to claim 9, wherein said outer surface identification indicia and said moldable identification indicia are identical.

11. A system according to claim 9, wherein said outer surface identification indicia are applied by an inkjet printer controlled by a computer, with said moldable identification indicia being formed by a scriber controlled by a computer.

12. A system according to claim 11, wherein said inkjet printer and said scriber are controlled by the same computer.

13. A system according to claim 9, wherein said data logger receives a signal transmitted from a camera trained upon the outer surface identification indicia.

14. A molding system including a subsystem for identifying castings and a subsystem for tracking casting process parameters, comprising:

a first controller for controlling a surface working tool so as to form unique moldable identification indicia in a workpiece shaping surface of a mold, with said first controller also controlling an external identification writer so as to apply unique outer surface identification indicia to an outer surface of the mold, with the moldable identification indicia and the outer surface identification indicia being in correspondence; and a second controller for controlling the filling of the mold, for receiving values of at least one sensed parameter associated with the molding process, and for recording a data set for each individual casting, with said data set including a signal derived from the outer surface identification indicia, and at least one parameter associated with the molding process, such that the recorded outer surface identification indicia and the recorded value of said at least one parameter will be maintained as a data set within a memory storage device within said second controller.

15. A system according to claim 14, wherein said first and second controllers comprise the same microprocessor computer.

16. A system according to claim 14, further comprising at least one sensor operatively connected with said second controller for sensing said at least one parameter and for transmitting a sensed value of the parameter to the second controller.

* * * * *